US005719374A

United States Patent [19]

Frackiewicz et al.

[11] Patent Number: 5,719,374

[45] Date of Patent: Feb. 17, 1998

[54] METHOD OF BENDING METAL OBJECTS WITH AN ENERGY BEAM

[75] Inventors: Henryk Frackiewicz; Zygmunt Mucha, both of Warszawa; Ryszard Gradoń, Kielce; Wojciech Kalita, Warszawa, all of Poland

[73] Assignee: Centrum Laserowych Technologii Metali Politechniki Swietokrzyskiej W Kielcach i Polskiej Akademii Nauk, Kielce, Poland

[21] Appl. No.: 738,712

[22] PCT Filed: Mar. 21, 1994

[86] PCT No.: PCT/PL94/00005

§ 371 Date: Nov. 23, 1994

§ 102(e) Date: Nov. 23, 1994

[87] PCT Pub. No.: WO94/21402

PCT Pub. Date: Sep. 29, 1994

Related U.S. Application Data

[63] Continuation of Ser. No. 343,465, Nov. 23, 1994, abandoned.

[30] Foreign Application Priority Data

Mar. 25, 1993 [PL] Poland ..... 298257

[51] Int. Cl.[6] ..... B23K 26/14; B21D 5/00; B21D 11/00

[52] U.S. Cl. ..... 219/121.66; 219/121.84; 219/121.85; 72/342.5

[58] Field of Search ..... 219/121.65, 121.66, 219/121.8, 121.84, 121.85, 121.35, 121.59; 72/342.1, 342.5, 379.2

[56] References Cited

U.S. PATENT DOCUMENTS

| | | | |
|---|---|---|---|
| 4,120,187 | 10/1978 | Mullen | 372/342.5 |
| 5,228,324 | 7/1993 | Frackiewicz et al. | 72/342.1 |
| 5,359,872 | 11/1994 | Nashiki | 219/121.8 |

FOREIGN PATENT DOCUMENTS

| | | |
|---|---|---|
| 3534796 | 4/1987 | Germany . |
| 62-110883 | 5/1987 | Japan . |
| 62-134117 | 6/1987 | Japan . |
| 2-220714 | 9/1990 | Japan . |
| 5-38524 | 2/1993 | Japan . |

*Primary Examiner*—Teresa J. Walberg
*Assistant Examiner*—Gregory L. Mills
*Attorney, Agent, or Firm*—Horst M. Kasper

[57] ABSTRACT

A method for bending metal objects along a straight bending line comprises a local heating of a selected strip of a metal object with an impinging broad energy beam. Thereupon, the selected strip is cooled by means of a cooling stream of a liquid. The cooling stream moves at a short distance behind the energy stream. Thereby, there results a bending of the metal object, where a convexity is produced on the side of the metal object impinged by the broad energy beam.

3 Claims, 10 Drawing Sheets

METHOD OF BENDING METAL OBJECTS WITH AN ENERGY BEAM

This is a file wrapper continuation application of application Ser. No. 08/343,465 filed Nov. 23, 1994 now abandoned.

BACKGROUND OF THE INVENTION

1. Field of the Invention

The subject of the invention is the method of bending and overbending of metal objects, in particular plates and shells of zero Gaussian curvature, along a straight line or along a set of straight lines.

2. Brief Description of the Background of the Invention Including Prior Art

Polish patent description no. 155358 teaches a method of bending metal objects characterized by the use of a "narrow beam", narrow as compared to the thickness of the metal bent. It allows bending of plates and shells of zero Gaussian curvature in such a way that on the side subject to be subjected to heat radiation a concavity is formed or enlarged. When, on the other hand, a shell of zero Gaussian curvature or an initially bent plate is being heated from the convex side, then this convexity will get diminished. The method of "narrow beam" has limited capacities of shaping the metal objects. It cannot be used to form closed cylindrical or conical surfaces of small internal diameters, since this would require introduction of the beam into the inside hollow space of these objects and then changing of the direction of the beam to the one perpendicular to the surface.

SUMMARY OF THE INVENTION

1. Purposes of the Invention

It is an object of the present invention to provide a method for forming closed cylindrical or conical surfaces having small inner diameters.

It is another object of the invention to increase the applicability of the method of bending metal objects with an energy beam.

It is yet another object of the present invention to provide a method for forming a bulging and a convexity on an irradiated side of a flat plate being irradiated and heated.

These and other objects and advantages of the present invention will become evident from the description which follows.

2. Brief Description of the Invention

The essence of the invention lies in the fact that the object shaped is subject to single or multiple local two-phase process of deep heating using the sufficiently broad energy beam along the straight line selected, and then cooling of the heated strip of metal in a natural manner or with the use of an external factor, in adequate distance behind the said beam. Consequently, the metal object undergoes permanent bending along the straight line and in particular when the flat plate is being heated a convexity is formed on the heated side, while when an initially bent plate or a shell with zero Gaussian curvature is heated then there will ensue the increase of the bending angle (increase of curvature), irrespective of the fact whether radiation was directed onto the convex or onto the concave side.

The energy beam, moving with velocity "V" along the straight line of bending (or overbending), heats the strip of width "a" and length "b" on the side to which heat radiation is applied, and on the other side it heats the strip of dimensions of at least one third of the width a and at least one third of the length b, to the temperature higher than the temperature "$T_1$", taken from a schematic diagram illustrating temperature-dependent plastic properties of metals, above which the plastic properties of the metal are enhanced.

The strip, heated with the energy beam, is being cooled with the stream of liquid at the distance b behind the said beam to attain the temperature of the environment or the temperature lower than $T_1$, with the cooling stream being directed onto the surface on the heated and/or non-heated side.

The minimum length $b_{min}$ of the heated strip cannot be smaller than its width taken two times.

For a flat plate the minimum width $a_{min}$ of the heated strip is equal at least seven times the thickness of the plate.

For the initially bent plate or shell, in which the depth "h" of the heated strip is smaller than half of the thickness "g" we can apply the same process of overbending as for the flat plates, with the minimum width $a_{min}$ of the heated strip calculated from the formula: $a_{min}=[7-6\times(h/g)]\times g$ For the initially bent plate or shell in which the depth h of the heated strip is equal or bigger than half of the thickness g, the process of further bending can be carried out by application of the energy beam to the convex and/or concave surface.

The minimum width of the heated strip, measured in its projection onto the plane tangent to its surface along the straight line of further bending, $a_{min}$, cannot be less than four times the thickness of material.

The smallest surface dimensions of the bent or further bent object cannot be less than five times the length b of the heated strip.

The smallest distance of the line of bending or overbending from the free edge of the plate or shell cannot be less than two times the width a of the heated strip a.

The radiation absorbers must be resistant to repetitive heating and cooling with a stream of liquid and cannot enter into chemical reactions with the metal they cover.

When we bend or overbend a plate or a shell of zero Gaussian curvature along a number of straight lines then we can form a new shell of a developable middle surface.

The method being the subject of the present invention, consisting in application of the "broad beam", makes it possible to overbend by directing the heat radiation on the external—convex—side. Another advantage of application of the "broad beam" is the possibility of obtaining bigger bending angles in single passage along the bending line than when the "narrow beam" is applied. It is shown below that application of the "broad beam" entails an entirely different mechanism of shaping within the metal (another setting of internal forces) from the one caused by the "narrow beam" and described in Polish patent description no. 155358. When comparing both methods of bending, the one with "narrow beam" and the one with "broad beam" it can be stated that these methods constitute mutually complementing ways of shaping, and taken together they allow carrying out of a broad class of shaping processes.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 4 showing the scheme of heating and cooling of the pre-bent plate or shell with the zero Gaussian curvature when the depth h of the strip is bigger than half of the thickness g. The energy beam of power E and diameter D moves along the straight line of initial bending with the velocity V, leaving behind the heated strip of material of (projected) width a, which is then cooled down at the distance b behind the said beam. Both heating and cooling can be carried out either from the convex or from the concave side. In each of these cases equal values can be adopted of $a_{min}$=4 g and $b_{min}$=2 a.

DESCRIPTION OF INVENTION AND PREFERRED EMBODIMENT

Figure 1:
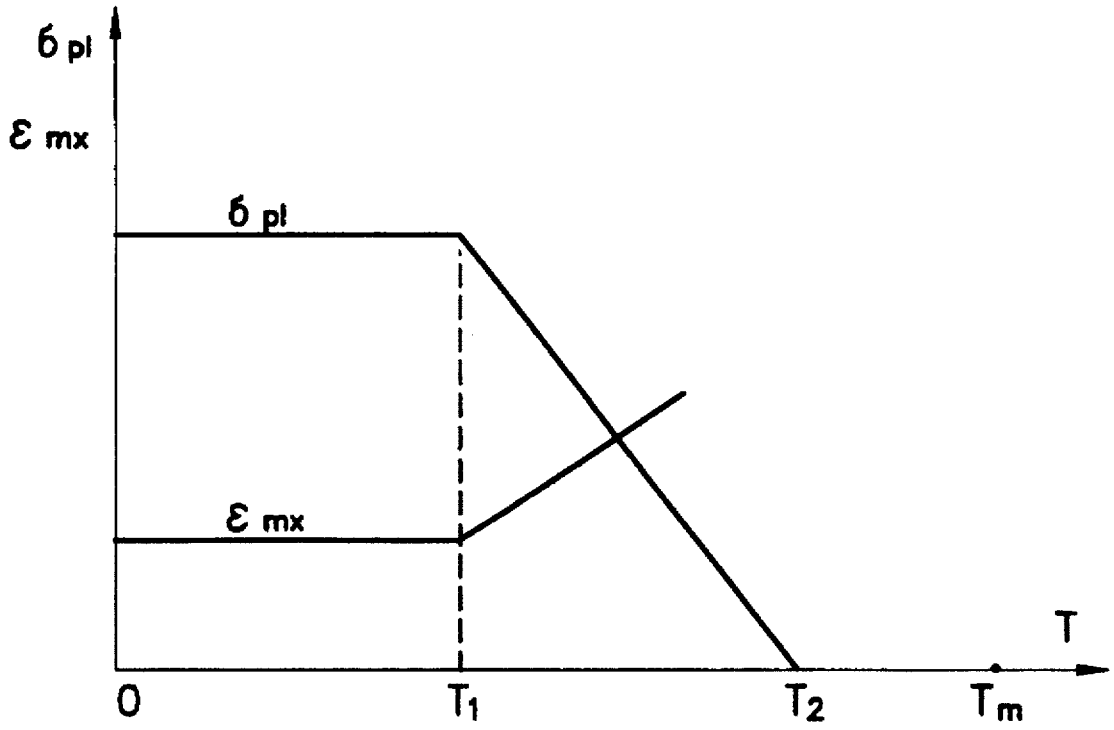
FIG. 1 presenting the commonly adopted simplified scheme of temperature-dependent plastic properties of metals. The ordinate axis represents the plasticity limit $\Sigma_{pl}$ and the maximum relative elongations $\epsilon_{mx}$ for the case of uniaxial tension, while the abscissa represents the temperature T of the metal. As can be seen from the mode, above the temperature $T_1$ the plastic properties of the metal get enhanced, the plasticity limit is lowered and the maximum relative elongation increases. The metal enters the state of plastic flow without application of any stresses at temperature $T_2$, and it melts in temperature $T_m$.

In the method of bending using the broad beam the shaping process is the outcome of the interaction between the heated strip and the material surrounding it, whose rigidity plays an essential role. That is why the straight line of bonding cannot be located nearer to the free edge of the material than at the distance of the width a of the heated strip.

During the heating phase the strip of material of width a, thickness g and length b is brought to such temperatures that at least the whole layer of the strip a×b, adjacent to the exposed surface, attains the state of enhanced plastic properties, and potentially a part of the layer of material of the strip (one third of width and one third of length b), adjacent to the opposite, unexposed, side of the material attains also the state of enhanced plastic properties.

The width a of the heated strip is usually determined by the conditions of bending (shaping) which we would like to realize and the parameters of the beam, power E, diameter D and velocity V, which can be achieved. There are, however, certain minimum widths $a_{min}$ of the heated strip, below which the method of bending described here cannot be realized. The widths $a_{min}$ depend upon the thickness g of the object shaped and upon the choice of the two kinds of shaping process to be carried out (bending of a flat plate, or overbending of a pre-bent flat plate or shell).

When the flat plates are bent the minimum width of the heated strip is $a_{min}$=7 g. The necessary condition for realization of the process is therefore satisfaction of the inequality $a>a_{min}$=7 g.

When the initially bent plates or the shells with zero Gaussian curvature are bent, the heated strip is the segment of the cylindrical surface of the depth h, width a (projected) and length b. The ratio of the strip depth h to its thickness g is here of primary importance.

When the depth h of the strip heated is less than half of its thickness g (h<0.5 g) then the pre-bent object or the shell of zero Gaussian curvature should be treated as flat elements. It is possible, though, to adopt for them other values of $a_{min}$, considering the fact of initial bending. These values are calculated from the formula $a_{min}=[7-6\ (h/g)]\times g$ When the depth h of the strip heated satisfies the inequality h>0.5 g then the above described principles of overbending are applicable to this pre-bent object or the shell, and the minimum (projected) width is $a_{min}$=4 g. The necessary conditions of h>0.5 g and $a_{min}$=4 g have to be satisfied in overbending.

In the cooling phase we aim at limitation of the length b of the heated strip and at reduction of the temperature of surrounding material to ambient temperature or at least to the temperature which does not influence plastic properties of the metal. Limitation of the length b of the heated strip increases also the rigidity of the material surrounding this strip. The length b should, however, be determined by the realized conditions of the bending or overbending process. It cannot be less than a certain lower limit value $b_{min}$. In order for the process to take adequate course the value of $b_{min}$=2 a should be adopted. Thus, the inequality $b_{min}>2$ a should be satisfied in the process of cooling. If natural cooling does not ensure satisfaction of this condition then artificial (forced) cooling should be applied by directing a cooling stream onto the heated strip at the distance b behind the energy beam. Good results can be obtained for numerous metals by water droplets sprayed in the stream of compressed air. The cooling stream can be directed both on the exposed and on the unexposed surface. Better effects are, however, obtained by cooling of the unexposed surface.

Satisfaction of all the above mentioned conditions of heating and cooling requires adequate selection of parameters of the energy beam, namely power E, diameter D and velocity V, as well as the parameters of the cooling stream. They should be adapted to the specific conditions of the bending or overbending performed.

The heated segment of the strip cannot freely expand under the influence of temperature because it is imbedded in the rigid surrounding material, and it therefore undergoes plastic flowing, while after cooling durable deformations appear in it. These deformations ensure:

in the case of a flat plate, pre-bent plate and a shell whose h<0.5 g—bending or increased bending, with the convexity directed towards the directly heated surface;

in the case of a pre-bent plate or a shell whose h>0.5 g—overbending increasing the curvature in the cross-section perpendicular to the straight line of initial bending (irrespective of the fact whether heat radiation is applied to the convex or concave surface).

As emphasized, in the process of bending and overbending with the use of the "broad beam" the essential role is played by the rigidity of the material surrounding the heated and cooled strip. Forces and moments appear at the boundaries of this strip, conditioning the processes of plastic flow in this belt, responsible for emergence of durable deformations. Together with the heated and cooled segment of the strip, these deformations move in the form of a "bending wave" along the bending line with velocity V. During this movement the conditions of absorption of heat and the rigidity of the material surrounding the strip change. These conditions undergo particular changes when the heated and cooled segment of the strip arrives at the free edge of the object.

All this causes that during the uniform heating and cooling the segment is subject to various angles of bending at each of the points on the bending line. In order to obtain a constant angle of bending along the bending line one of the following ways of proceeding should be applied:

The first one consists in appropriate changes of parameters of heating and cooling during the movement of the beam along the bending line.

The second one consists in application of additional overbending procedure along appropriate segments of the straight line after the first bending has been obtained, characterized by the variable angle.

The above described durable bending or overbending of a plate or shell with zero Gaussian curvature is conditioned, as mentioned already, by the internal forces and moments appearing at the boundaries between the heated segment of the strip and the colder rest of the material. The essential role is played in the considered process of bending or overbending with the use of broad beam by the bending moments, responsible for the bending of the strip. The forces tangent to the middle surface, on the other hand, cause swelling (bulging) of the material and they should therefore be kept small. Such a setting of internal forces, correct from the point of view of bending, arises-when the dimensions of the strip a×b are possible large in comparison with thickness g.

Internal forces in the material appearing at the boundaries of the heated strip are also conditioned by the rigidity of the material surrounding this strip. With the given thickness g the rigidity increases along with the increase of dimensions of the element being bent or overbent. The rigidity can be considered sufficient from the point of view of bending or overbending with the broad energy beam when the smallest of dimensions of the element is at least five times bigger than the length b of the strip heated. Bending of such an element will be most effective when the strip heated is located in its center. When the heated strip is located, on the other hand, nearer to one of the free edges, then the rigidity and therefore also the effectiveness of the process will decrease. The previously provided conditions on the minimum values $a_{min}$ and $b_{min}$ refer to the situation when the segment heated is located in the center of the object whose smallest dimension is at least five times bigger than the length b.

Due to good heat conductivity of metals the two phases of the bending process—heating and cooling—have a very rapid course. Thereby, excessive growth of grains in the structure of metal does not occur, though the new phases of this structure, characteristic for rapid cooling, may appear. In the high-carbon content steel alloys we can also observe the phenomenon of inter-crystalline diffusion of carbon.

The heated strip attains the temperatures which are sufficiently high to cause enhancement of plastic properties of the metal, so that metals, even hard and brittle ones, can be bent without internal cracks. The more a given object to be bent is hard and brittle, the more carefully the process should be conducted. The maximum temperatures in the area of the heated strip should be lower than the melting temperature of the object. This requirement may not be kept to in certain cases, like when very thick plates are bent, but only when technical conditions allow for it.

There are also alloys which display the so called hot brittleness in a certain interval of high temperatures. In these cases the bending process should be conducted in such a way as to secure that the plastic flowing take place in temperatures higher than those causing hot brittleness.

The heating process requires for many metals application of the special absorbers preventing reflection of the energy beam from the surface exposed to thermal radiation. These absorbers must display resistance to repetitive action of the energy beam and the cooling stream, and must not enter in chemical reaction with the heated metal.

Various energy beams can be applied to heat metals in the here considered process of bending. Still, the best results were achieved with application of the high power laser, whose energy beam can be precisely controlled as to its power and direction.

Figure 2:
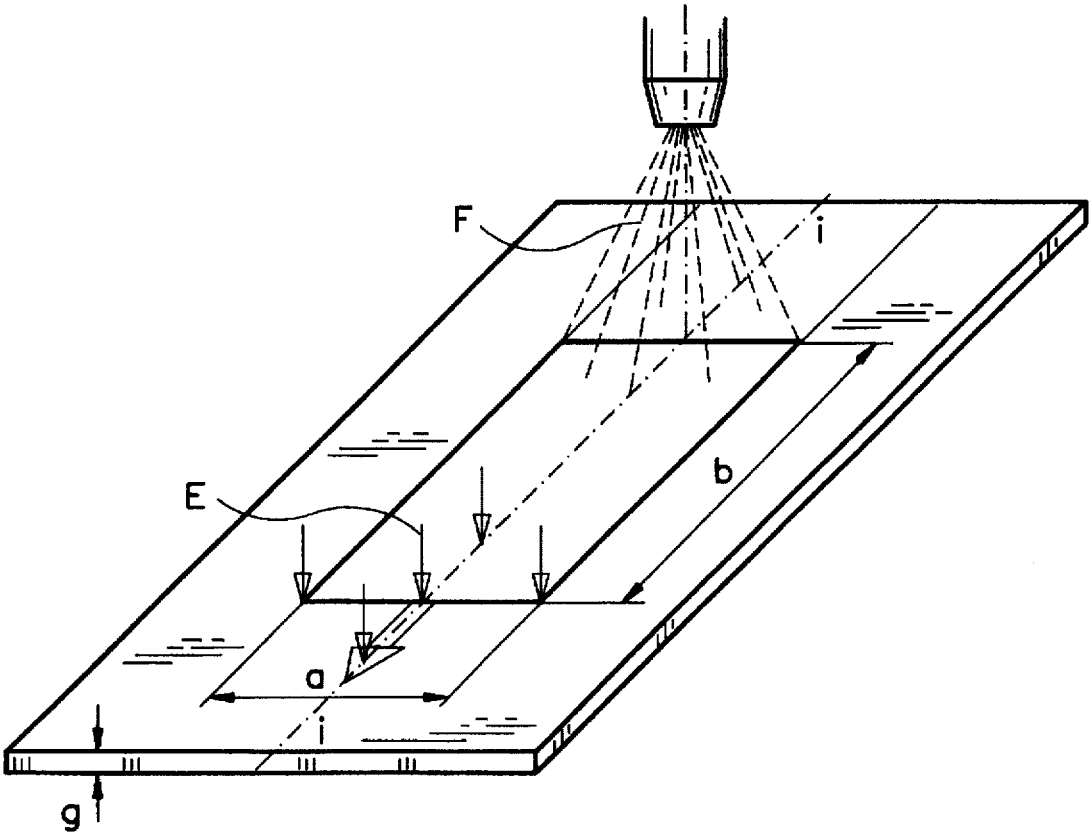
FIG. 2 presenting the scheme of heating and cooling of a flat plate. An energy beam of power "E" and diameter "D" moves along the straight line of bending i-i with the velocity V with respect to the object, leaving behind the heated strip of metal of width a, which is being cooled down at the distance b behind the beam. Cooling can be carried out both on the side of the object to which heat radiation is applied and on the opposite side.

Bending of the flat plate having constant thickness by the use of the broad energy beam with respect to the straight line i-i as in FIG. 2 can be done in such a way that the convexity appears from the side exposed to thermal radiation. This will be bending "away from the laser".

Figure 3:
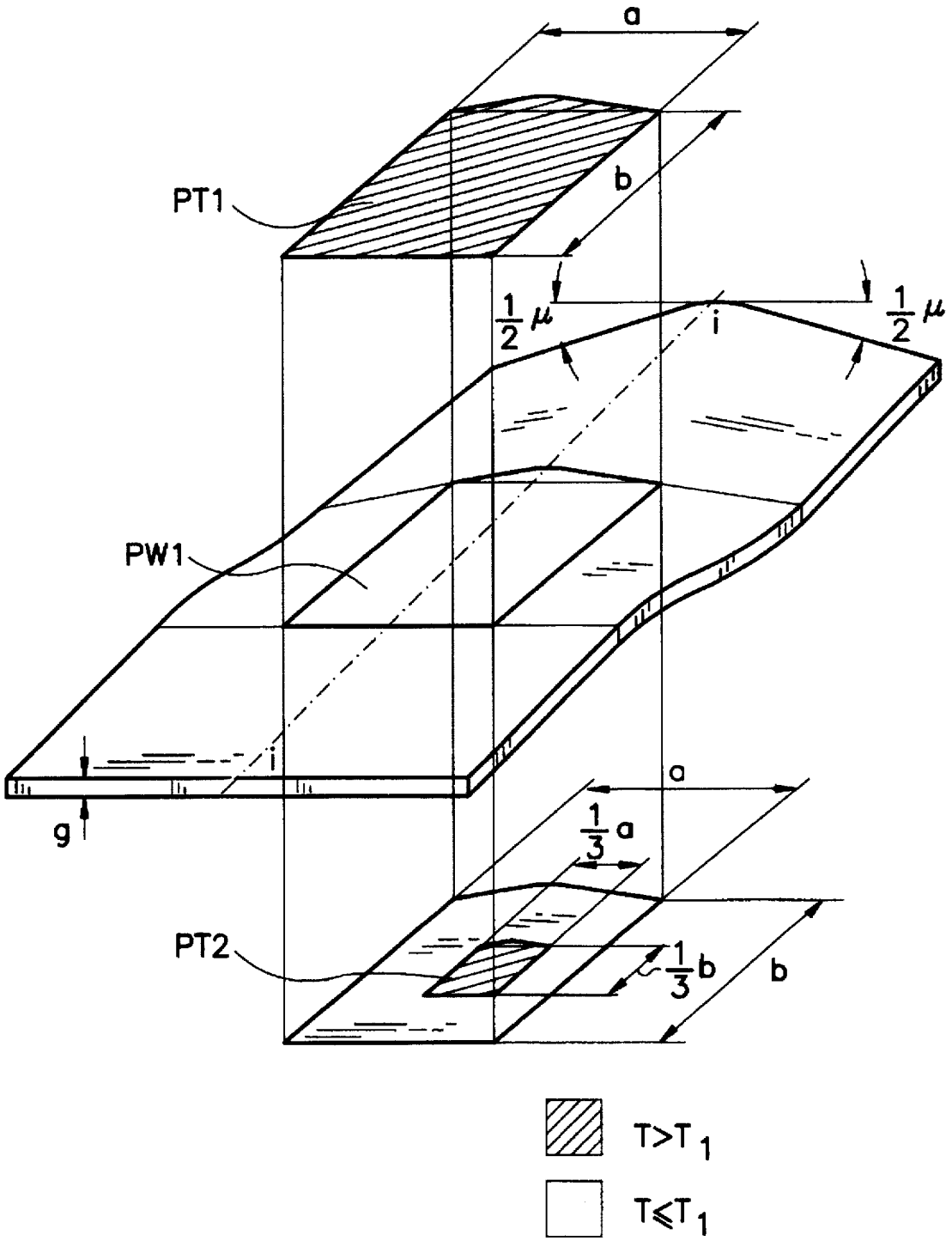
FIG. 3 presenting the deformations and the minimum degree of heating of the strip a×b×g. It can be seen from the diagram that on the directly heated side the whole surface a×b has to attain the temperature higher than $T_1$, while on the unexposed side at least the strip of dimensions of one third of a and one-third of b has to attain the temperature higher than $T_1$. The bending process is of course much more effective if the whole surface a×b on the unexposed side is brought to the temperature higher than $T_1$.

At the beginning the appropriate parameter values of the beam, E, D, V, should be selected in such a way as to create the heated strip of the dimensions a×b×g and the temperature distribution at least as the one shown in FIG. 3. The minimum width $a_{min}$ of the strip heated is $a_{min}$=7 g. Application of $a_{min}$=7 g yields, however, the bending directed with its convexity towards the side exposed to direct heating only in the case of maximum rigidity of the material surrounding the heated strip. And this occurs only when the dimensions of the bent plate, that is—its length and width—are bigger than 5 b;

the straight line of bending is located at at least the distance 2 a from the free edge;

the process of heating and cooling is started from the center of the line of bending and the segment heated moves first in the direction of one free edge and then in the direction of the second free edge.

Using the diagram of FIG. 1, proper for a given kind of metal, the temperature $T_1$ is determined whose exceeding ensures enhancement of the plastic properties of the material in the heated strip. FIG. 3 shows only a minimum scope of heating of the strip segment. Raising of the temperature of both surfaces, the exposed and the unexposed one, within the rectangles a×b, to the temperature above $T_1$, which is feasible for thinner sheets, always increases effectiveness of bending. During heating we can of course admit to have in the central parts of the rectangle a×b on the exposed side the temperature T contained in the interval defined by the inequality $T_1<T<T_m$.

The width a of the heated strip must of course satisfy all the conditions previously mentioned, but its concrete magnitude should be defined by the conditions of a given bending process. It should be emphasized, here, however, that along with the increase of the width a there is the increase of the necessary power E, and simultaneously of the angle μ of bending and of the radius of curvature of the bent strip in the cross section perpendicular to the bending line.

Cooling of the heated strip should take place at the distance b behind the energy beam. In order to carry out correctly the bending process with the method of "broad beam" here described the distance b must satisfy the inequality b>2a. Increase of b enhances the effectiveness of bending (angle μ) only when this does not cause excessive decrease of rigidity of the material surrounding the heated strip. The value of b depends, of course, upon the power E of the energy beam we dispose of. The concrete choice of distance b should be dictated by the conditions of the concrete bending process.

As mentioned previously, realization of bending of a plate along a straight line under constant parameters E and V of the beam leads to variable angle μ of bending along the line of bending. In order to obtain a constant angle μ either the parameters E and V of the beam should be accordingly changed during the process, or overbending applied.

Figure 6A:
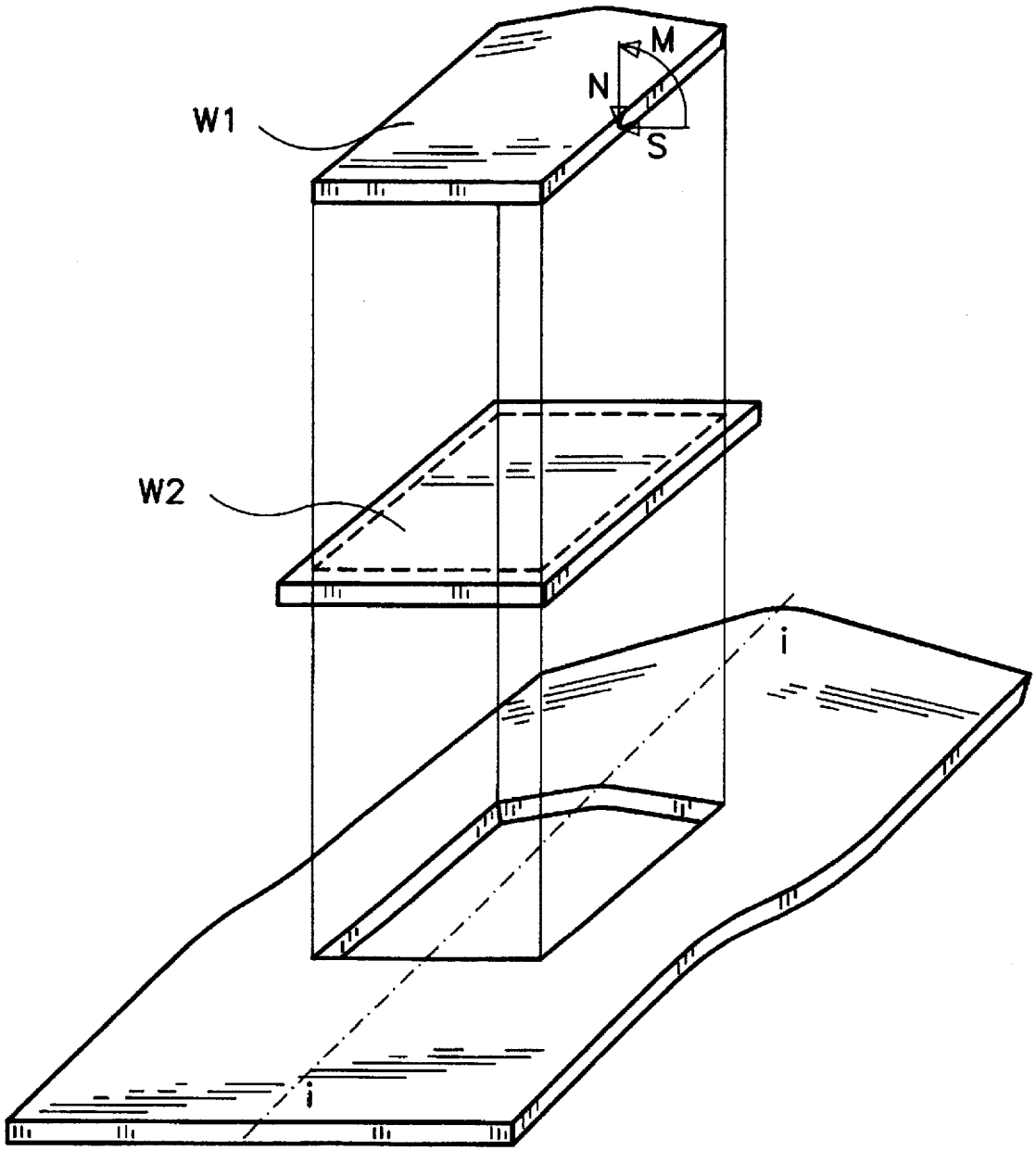
FIG. 6*a* and 6*b* showing the characteristics of the system of forces acting between the strip heated and the remaining rigid and cooler material.
Figure 6B:
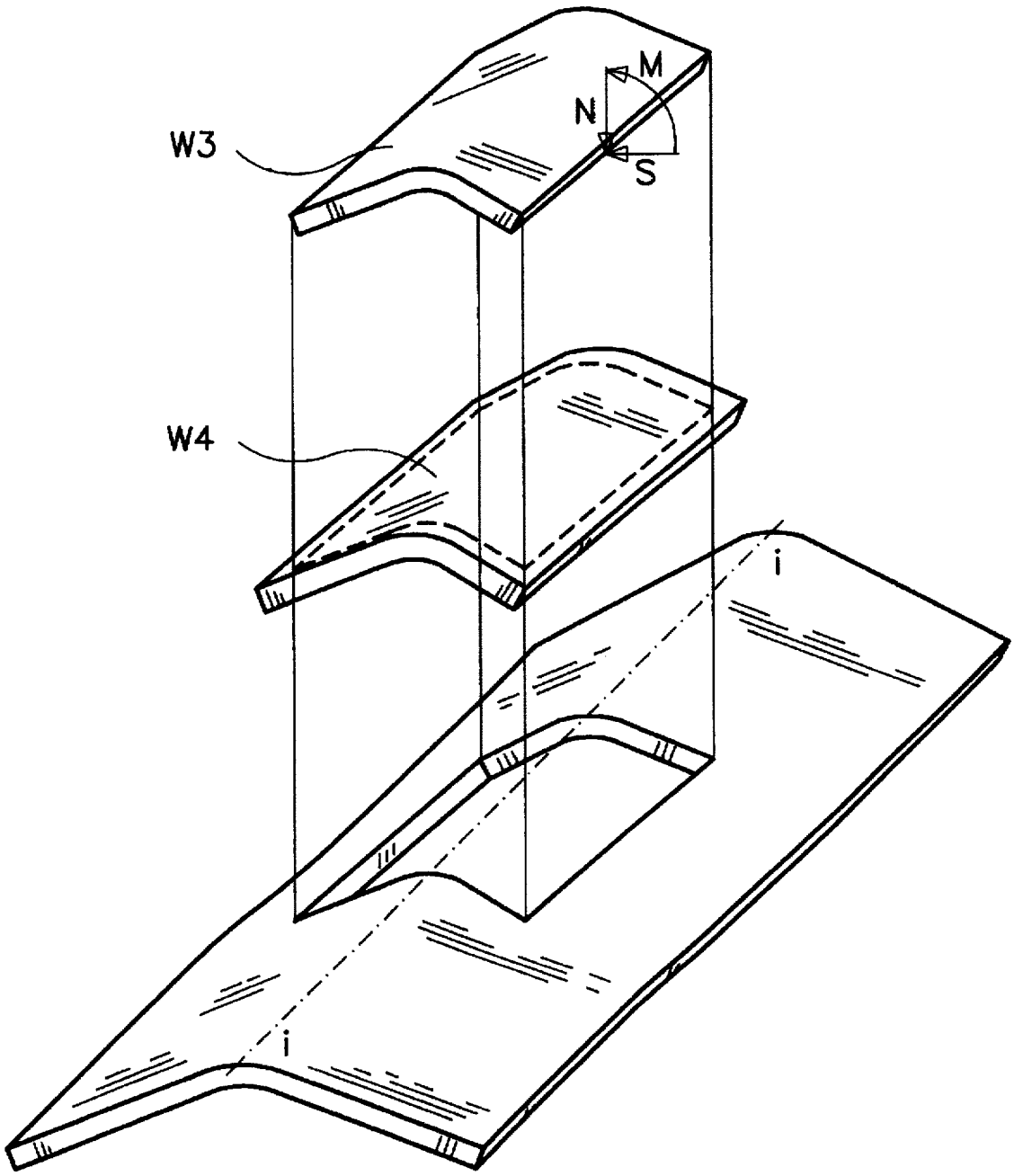
Figure 7A:
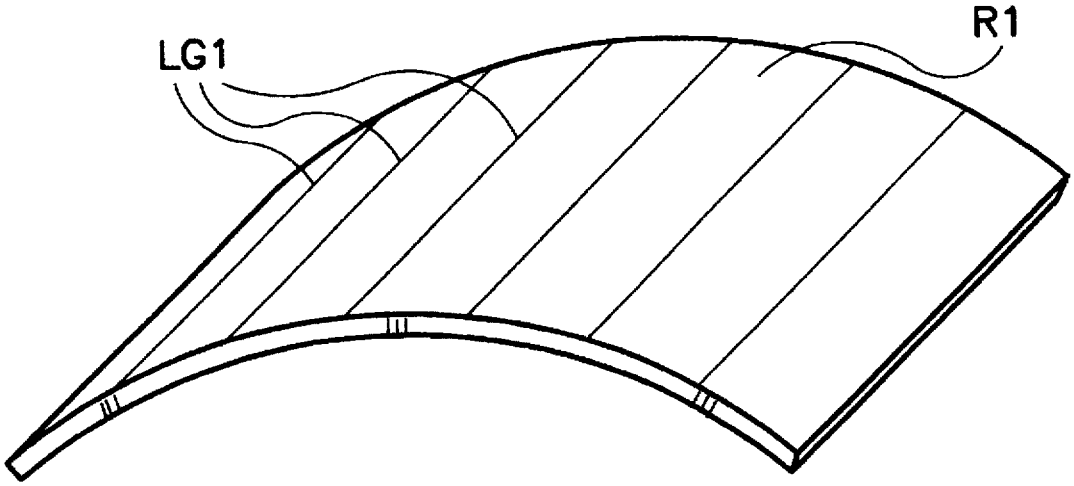
FIGS. 7*a* and 7*b* showing the examples of shaping of the cylindrical and conical surfaces, with their convexity directed towards the surface exposed to direct heating, these shapes being obtained through consecutive bendings along appropriate straight lines.
Figure 7B:
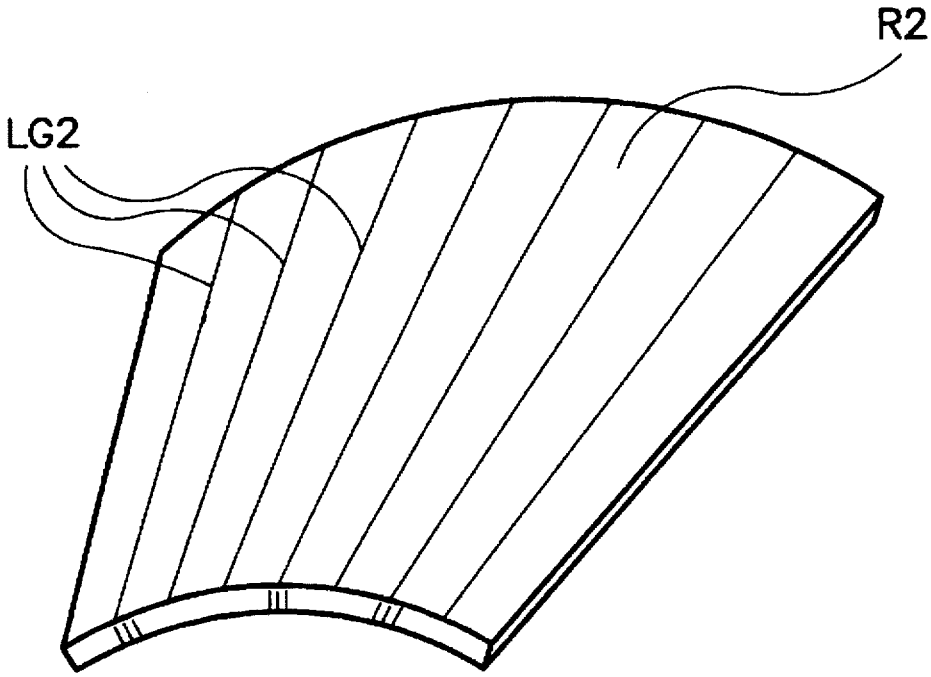

FIG. 6 shows the setting of internal forces and moments, which appears at the boundaries of the heated strip, and which conditions the appearance of the plastic flow process in this strip. From the point of view of correctness of the process realized the bending moments M are the most desirable. The forces tangent to the middle surface of the sheet, S should be possibly small, since they cause bulging of the sheet at the location of bending, which is not the objective of the process carried out. These forces decrease with the increase of a and b. As the process of plastic flow progresses the forces at the boundaries of the heated strip decrease, and after cooling they can even change their sign. They remain in the material bent as certain residual internal stresses (usually small) and they can be removed by the seasoning process, which is naturally accompanied by a slight change of shape.

Overbending of a pre-bent plate of constant thickness with the help of a broad beam can be carried out using the sufficiently broad beam of energy by the method described above. It can also be bent mechanically or by the use of the narrow energy beam according to the method given in Polish patent description no. 155 358. For the method presented here it is important that the elevation of the strip heated during overbending be sufficiently big. Thus, the elevation h should not be less than half of the thickness g of the plate being overbent. Then, the minimum width of the strip is $a_{min}=4$ g.

Figure 4:
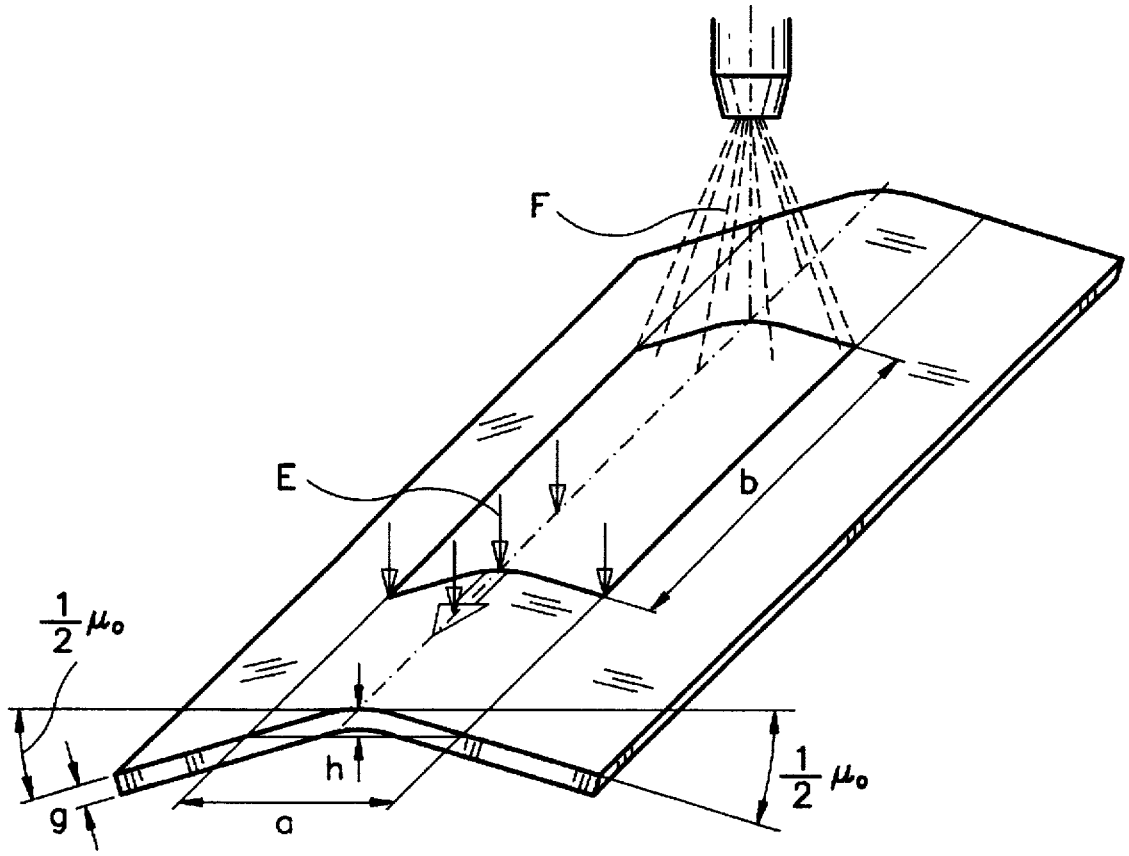
Figure 5:
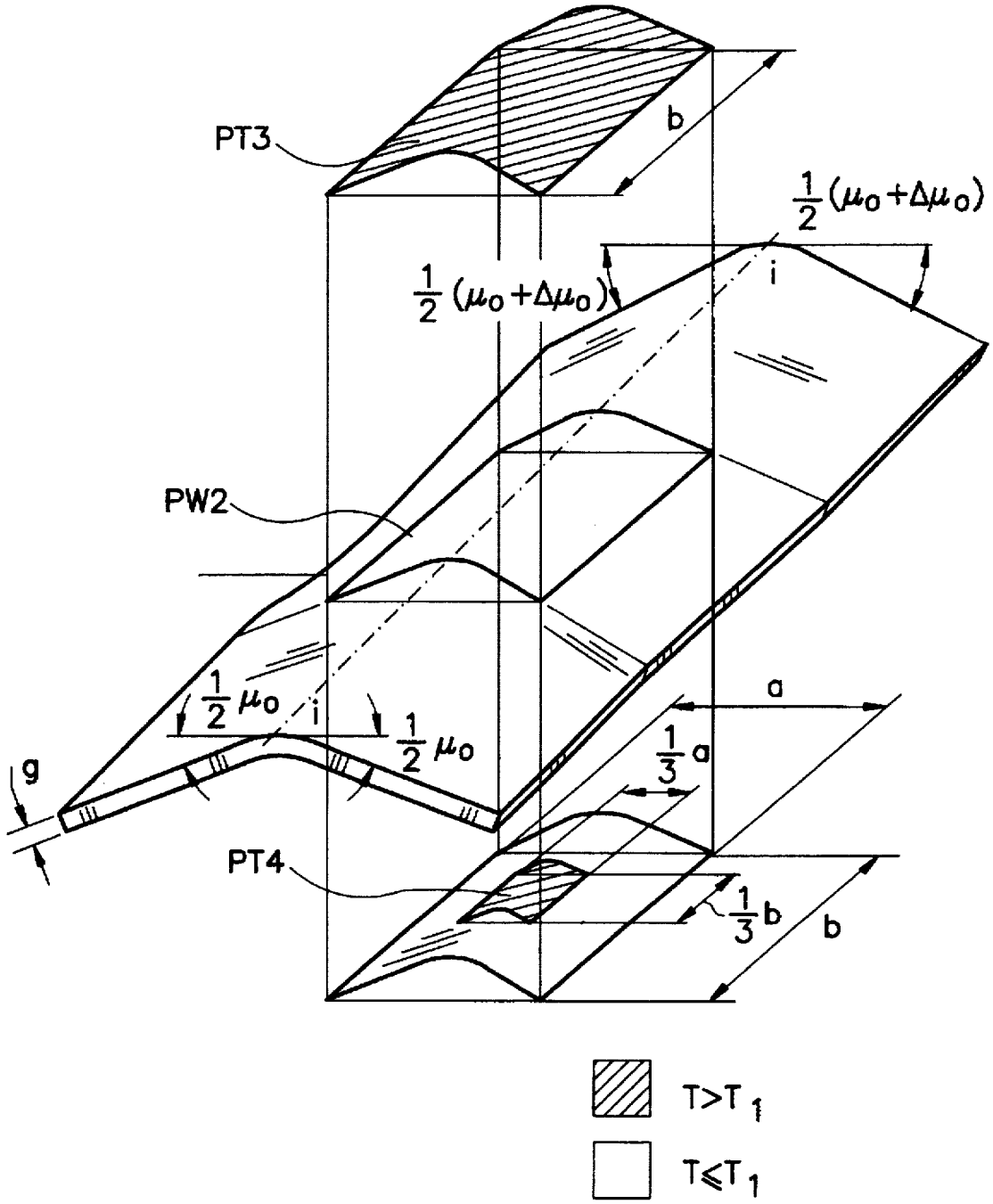
FIG. 5 showing the diagram of the deformations and the minimal degree of heating of the strip a×b×g of the depth h>0.5 g, irrespective of the fact whether the convex or concave side is exposed to direct heating. It can be seen from the figure that the whole strip surface a×b on the exposed side should be heated to the temperature above $T_1$, while on the unexposed side at least the rectangle of dimensions of one third of a and one third of b should be heated to the temperature above $T_1$. Satisfaction of these conditions assures durable overbending, irrespective of the method of heating or cooling.

When the above condition is satisfied we can overbend a pre-bent plate or a shell of zero Gaussian curvature, irrespective of the fact whether we direct the broad beam of energy along the line of bending onto the convex or onto the concave surface. The strip heated, however, has to form in horizontal projection (FIG. 4) a rectangle of width $a>a_{min}=4$ g and length $b>b_{min}=2$ a. Minimum heating of the strip is shown in FIG. 5. When the strip is heated to higher temperatures, the intensity of overbending increases. During overbending of thin plates it is possible to heat the strip in such a manner that both surfaces, the exposed and the unexposed one, attain the temperatures higher than $T_1$, $T_1<T<T_m$, over the whole area of the rectangle.

The heated strip of dimensions a×b (in projection onto a plane) cannot freely expand according to the temperature increase, since it is fixed within its boundaries in the surrounding colder material of definite rigidity. Due to this rigidity the forces and moments appear at the boundaries of the strip, causing overbending of the strip and the processes of plastic flow leading to the durable increase of the angle of bending. The theoretical and experimental analysis indicates also that if only the elevation h of the strip satisfies the conditions given above, the process proceeds in the same direction irrespective of the side which is exposed to heat radiation—concave or convex. In the overbending process described here the essential role is played by the bending moments M, which cause overbending without entailing bulging (swelling) of the material. Appearance of greater forces S, tangential to the middle surface of the material, at the boundaries of the strip, means that besides overbending there can also additionally appear bulging of the material, not being the objective of the overbending process here considered. Overbending with application of greater a and b is advantageous for minimization of bulging and for the increase of the overbending angle μ. One should also remember the rigidity of the material surrounding the strip heated. As emphasized already before, in order to ensure adequate rigidity the smallest of the dimensions of the object subject to overbending must be at least 5 times bigger than the length b of the strip cooled.

Cooling of the previously heated strip during overbending, performed at the distance b behind the energy beam may be carried out by directing the cooling stream either on the convex surface or on the concave one. The greatest effectiveness of overbending is achieved when the energy beam is directed on the convex surface, while the cooling stream—on the concave surface.

Overbending of the pre-bent plate or shell of zero Gaussian curvature is presented in FIG. 5. This figure shows the "overbending wave" over the length b, this wave increasing the angle of the initial bending by the value $\mu_o$. The wave mentioned moves along the line of bending with the velocity V.

The system of internal forces at the boundaries of the deformed, heated strip, presented in FIG. 6, is similarly relevant to the case of bending of a flat plate and to the case of overbending of the initially bent plate or shell with zero Gaussian curvature, with the elevation being much bigger in the case of overbending.

EXAMPLE 1

Figure 8:
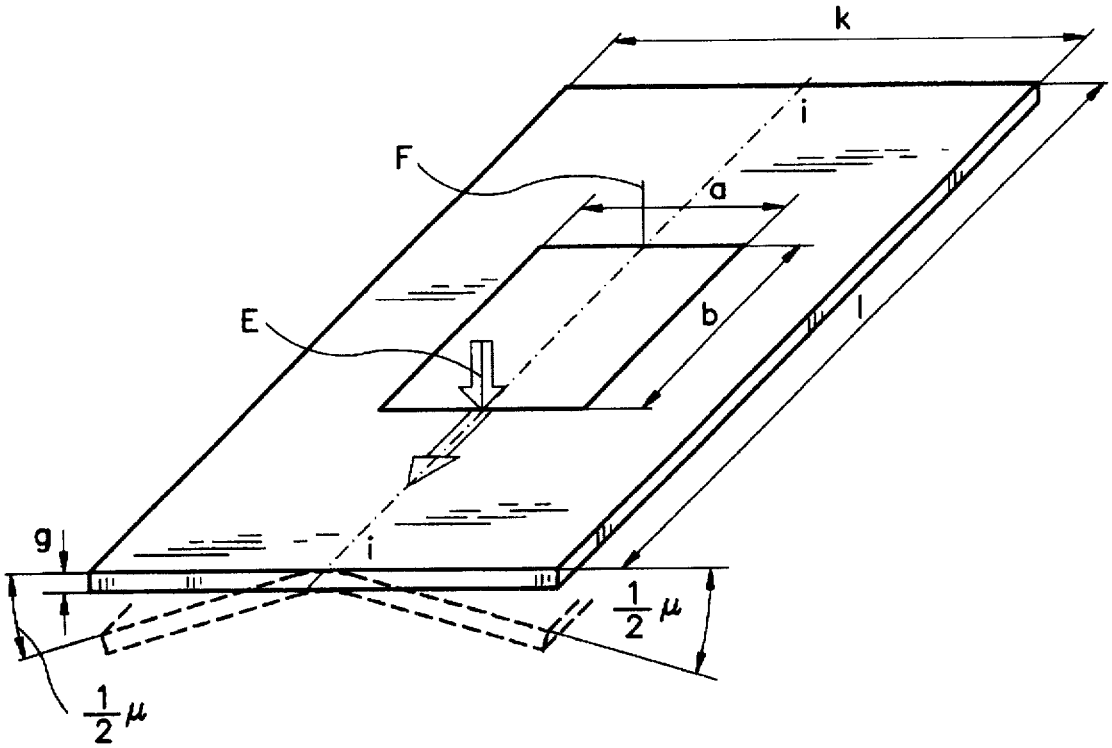
FIG. 8 showing the example of the bending of a steel plate with a broad beam.

The example selected for illustration of the method here described refers to the plate of stainless steel having dimensions as indicated in FIG. 8, bent along the axis of symmetry i-i. $CO_2$ laser beam was used having the following parameters: E=250 W, V=140 millimeters per minute (mm/min.), D=9 min. In this case $T_1=550°$. The strip of dimensions a=9 mm×b=20 mm was heated to the average temperature $T_{av}=700°$ on both sides. Cooling was carried out with water sprayed in the stream of compressed air. The bending angle obtained in a single traverse of the beam along the bending line from the center of the line to the free edge and then from the center of the line to the opposite free edge was $\mu=2.5°$.

EXAMPLE 2

Figure 9:
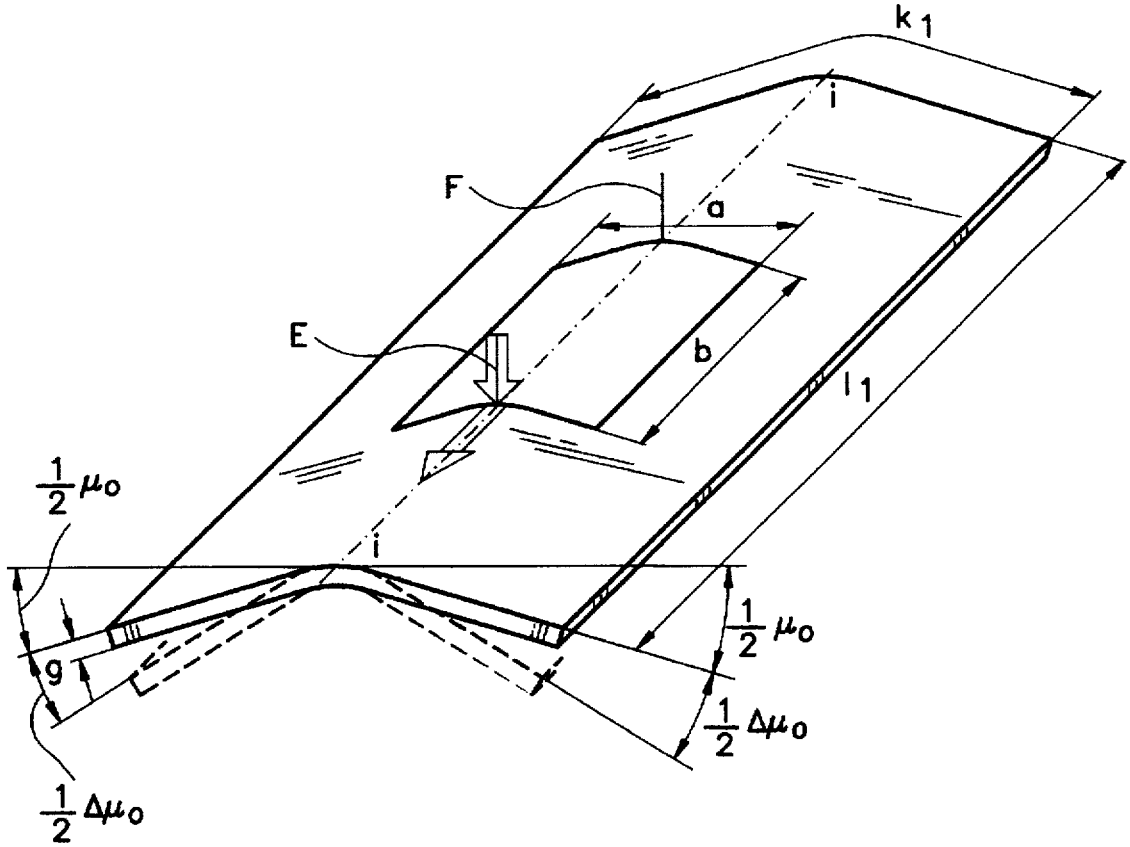
FIG. 9 showing the example of overbending of a pre-bent steel plate with a broad beam.

FIG. 9 presents the effect of overbending of the pre-bent steel plate having the angle of initial bending of $\mu_o=23.7°$. Overbending was performed with the $CO_2$ laser beam of 1,000 W of power (E), velocity V=370 mm/min., and the diameter of the beam D=12.8 mm.

Direct heating was applied to the convex surface of the initial bending. The width a of the strip heated to temperature exceeding $T_1$ was the same on the exposed and unexposed sides and was a=12 mm, while the length b was 30 mm.

The overbending angle obtained in one traverse of the beam along the bending line was $\Delta\mu_o=1.8°$. A second experiment carded out with the beam of the diameter D=4 mm resulted in $\Delta\mu_o=-0.2°$, meaning that the initial angle of bending diminished due to too small width of the strip heated.

It will be understood that each of the elements described above, or two or more together, may also find a useful application in other methods of bending metal objects differing from the types described above.

While the invention has been illustrated and described as embodied in the context of a method of bending metal objects with an energy beam, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of bending and overbending of metal objects along straight lines wherein the metal objects are at least one of plates and shells having zero Gaussian curvature, comprising:

determining a temperature $T_1$ for a metal object to be bent, wherein the temperature $T_1$ is a temperature at which plastic properties of the metal object are enhanced; applying a broad energy beam for irradiating a strip of the metal object;

moving the broad energy beam with a velocity V along a straight bending line and heating the strip to a temperature exceeding the temperature $T_1$, wherein said strip is a heated strip having a defined thickness g and having a defined width a and a defined length b on a side of the strip exposed to radiation and having at least one third of the defined width a and one third of the defined length b on an unradiated side and wherein a minimum width $a_{min}$ of the heated strip equals at least seven times the defined thickness g of the strip when the metal object is a flat plate, and wherein the minimum width $a_{min}$ of the heated strip, measured in a projection on a plane tangent to its surface along a straight line of bending, is calculated from a formula $a_{min}=(7-6\times(h/g))\times g$ when the metal object is an initially bent plate having a bending depth h of the heated strip smaller than a half of the defined thickness g and equals four times the defined thickness g when the metal object is the initially bent plate having the bending depth h of the heated strip bigger than half of the thickness g, and wherein a minimum length $b_{min}$ of the heated strip is larger than twice the defined width a of the heated strip and wherein a smallest dimension of a surface of the metal object to be bent or overbent is not less than five times the defined length b of the heated strip and wherein a smallest distance of the straight bending line of bending or overbending from any free edge of the metal object is not less than twice the defined width a of the heated strip; and cooling thereupon the strip by means of a cooling stream of a liquid directed onto at least one of the side exposed to radiation and the unradiated side until achieving an ambient temperature or a temperature lower than the temperature $T_1$, wherein the cooling stream moves at a distance equal to a defined length b behind the broad energy beam thereby producing a convexity on the side of the strip exposed to radiation, and wherein a heating and cooling process is started from a center of the straight bending line.

2. The method according to claim 1, characterized in that the heated strip is cooled by the stream of liquid at the distance b behind the energy beam to the ambient temperature or to the temperatures lower than $T_1$, with the cooling stream of liquid directed onto at least one of the side of the strip exposed to heat radiation and an unexposed side.

3. The method according to claim 1, characterized in that for a pre-bent plate or shell, in which the bending depth h of the heated strip is equal to or greater than half of the defined thickness g, an overbending is performed with the broad energy beam directed on at least one of a convex surface and concave surface.

* * * * *